US005314504A

United States Patent [19]

Holfeld et al.

[11] Patent Number: 5,314,504

[45] Date of Patent: May 24, 1994

[54] PROCESS FOR THE APPLICATION OF DYE FIXING AGENTS TO POLYAMIDE FIBER UTILIZING CONTROLLED FIXING AGENT ADDITION

[75] Inventors: Winfried T. Holfeld; Dale E. Mancuso, both of Wilmington, Del.

[73] Assignee: E. I. Du Pont de Nemours and Company, Wilmington, Del.

[21] Appl. No.: 69,046

[22] Filed: May 28, 1993

Related U.S. Application Data

[63] Continuation-in-part of Ser. No. 745,044, Aug. 14, 1991, Pat. No. 5,203,709, which is a continuation-in-part of Ser. No. 614,535, Nov. 15, 1990, abandoned.

[51] Int. Cl.[5] ..... D06M 15/00; C09B 67/00

[52] U.S. Cl. ..... 8/115.56; 8/557; 8/558

[58] Field of Search ..... 8/115.56, 557, 558, 8/115.54

[56] References Cited

U.S. PATENT DOCUMENTS

| | | | |
|---|---|---|---|
| 3,710,601 | 5/1971 | Blanc et al. | 68/18 C |
| 3,738,803 | 6/1973 | Blanc et al. | 8/93 |
| 3,932,127 | 1/1973 | D'Albignac | 8/173 |
| 3,966,406 | 6/1976 | Namiki et al. | 8/179 |
| 4,125,371 | 11/1978 | Beutler et al. | 8/176 |
| 4,351,076 | 9/1982 | von der Eltz et al. | 8/149.1 |
| 4,483,032 | 11/1984 | Christ et al. | 8/149.1 |
| 4,629,465 | 12/1986 | Hasler et al. | 8/400 |
| 4,820,312 | 4/1989 | von der Eltz | 8/533 |
| 4,885,814 | 12/1989 | von der Eltz | 8/149.1 |

FOREIGN PATENT DOCUMENTS

| | | |
|---|---|---|
| 1254541 | 11/1971 | European Pat. Off. . |
| 2624176 | 12/1983 | Fed. Rep. of Germany . |
| 2823543 | 11/1987 | Fed. Rep. of Germany . |
| 1299777 | 12/1972 | United Kingdom . |

*Primary Examiner*—Paul Lieberman
*Assistant Examiner*—Margaret Einsmann

[57] ABSTRACT

A process for increasing the washfastness of a fibrous article containing polyamide fibers dyed with anionic dye by treatment with an anionic dye fixing agent. The process includes immersing the article in a liquid bath of either an aqueous or substantially nonaqueous solvent medium for the fixing agent and heating to a temperature at least equal to the dyeing transition temperature of the fiber. The fixing agent is added to the bath so that the rate of fixing agent addition to the bath is the primary control over the rate of fixing uptake by the article at the early stages of aftertreating. In the later stages, the rate of fixing agent addition controls the concentration in the bath whereby the propensity for the fixing agent to agglomerate from the bath is decreased.

9 Claims, 1 Drawing Sheet

PROCESS FOR THE APPLICATION OF DYE FIXING AGENTS TO POLYAMIDE FIBER UTILIZING CONTROLLED FIXING AGENT ADDITION

BACKGROUND OF THE INVENTION

The present invention is a continuation-in-part of application Ser. No. 07/745,044, filed Aug. 14, 1991, now U.S. Pat. No. 5,205,709, which is a continuation-in-part of application Ser. No. 07/614,535, filed Nov. 15, 1990, now abandoned.

The present invention relates to the application of dye fixing agents to fibrous articles containing anionically dyed polyamide fibers and more particularly relates to such a process utilizing controlled addition of dye fixing agents to a bath containing such articles.

A variety of fixing agents are known for application to polyamide fiber to improve dye washfastness. These agents are typically compounds or low molecular weight polymers with anionic groups which can associate with the nitrogen-containing groups of the polyamide polymer and form a surface layer that reduces diffusion of the dye out of the treated fiber. "Syntan" is usually used to describe the class of synthetic fixing agent including condensation products of aromatic sulfonic acids and formaldehyde. The word syntan is a contraction of the term "synthetic tannins" since tannic acid and/or tartar emetic were first used as fixing agents for polyamide fibers.

Syntans are sometimes referred to as "colorless acid dyes" and these fixing agents have conventionally been applied to polyamide fiber articles using procedures like those used for the application of dye. Typically, the original dyebath is dropped, the article is rinsed, and a new bath is provided. The syntan is added and the bath temperature is raised slowly to the application temperature.

However, unlike most acid dyes which impart color, solutions of fixing agents such as syntans are unstable to shear forces such as those to which a fixing agent solution may be subjected in the venturi nozzle and/or circulating pump of a jet dyeing machine. The shear forces in jet dyers often cause fixing agent solutions to "break" and the fixing agents may come out of solution and agglomerate. The resulting agglomerates adhere to the fabrics being aftertreated, causing objectionable deposits or spots.

SUMMARY OF THE INVENTION

The invention provides an improved process for increasing the washfastness of a fibrous article containing polyamide fibers dyed with anionic dye by treatment with an anionic dye fixing agent. A process in accordance with the invention includes immersing the article in a liquid bath of either an aqueous or substantially nonaqueous solvent medium for the fixing agent. The bath and the article are heated to a temperature at least equal to the dyeing transition temperature of the fiber of polyamide polymer. The fixing agent is added to the to the bath as a liquid concentrate with at least about 33% of the total fixing agent to be applied during the process being added while the bath and the article are at a temperature at least equal to the dyeing transition temperature. The bath is stirred as the fixing agent is added to the bath to mix the concentrate into the bath to form a dilute solution of the fixing agent and to provide a flow of the dilute fixing agent solution relative to the article to cause the fixing agent to be transported to the article, the stirring further providing, on the average, essentially uniform transport of the fixing agent to the article. The fixing agent is added to the bath so that the rate of fixing agent addition to the bath is the primary control over the rate of fixing agent uptake by the article at the early stages of aftertreating. In the later stages, the rate of fixing agent addition controls the concentration in the bath whereby the propensity for the fixing agent to agglomerate from the bath is decreased.

In one form of the invention, the dye fixing agent is added at an addition rate of about 0.0005 to about 0.5% fixing agent/minute based on the weight of the article.

In another form of the invention in which the process is performed in a dyeing machine in which the stirring provides repetitive machine cycles, the dye fixing agent is added to the bath at an addition rate such that between about 0.04% and about 7% of the total fixing agent to be applied during said process is added to said bath during a machine cycle.

DETAILED DESCRIPTION

Figure 1:
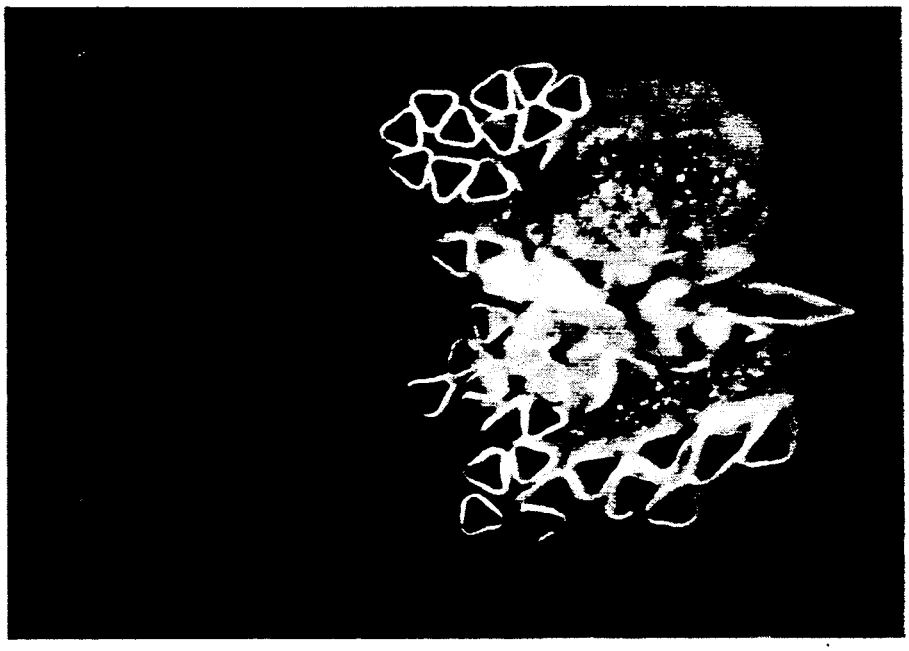
FIG. 1 is a cross-sectional photomicrograph at 200× of a yarn in a fabric after-treated in accordance with the invention.

The process of the invention is useful for after-treating articles to improve dye washfastness which contain dyed fibers of a variety of polyamides. The invention is particularly useful for fibers made from aliphatic polyamide homopolymers and copolymers which are melt-spinnable to form fibers which are amenable to processing for textile uses. A preferred class of such polyamides contains at least one of poly(hexamethylene adipamide) or poly(ε-caproamide) polymer units in an amount greater than about 60% by weight. A most preferred class of polyamides contains at least about 85% by weight poly(hexamethylene adipamide). In the examples which follow, homopolymer poly(hexamethylene adipamide) is referred to as 66 nylon.

There are a wide variety of fibrous articles containing polyamide fibers which can be after-treated using the process of the invention including, for example, yarns, fabric, carpets and garments. Fabrics include the usual textile forms including woven, knitted, and non-woven varieties. The polyamide fiber in such articles can be present in a wide variety of forms including flat or textured continuous filaments, staple yarns, bulked continuous filaments, etc. The polyamide fiber can be present in the article together with any of a variety of other synthetic or natural fibers. Typical of such articles are staple yarns made from a "blend" of polyamide staple with other fibers and fabrics and garments made from such yarns. The invention is particularly useful with fabrics containing continuous filament polyamide yarns together with elastic fibers such as spandex sold under the trademark Lycra® by E. I. du Pont de Nemours & Company. The other fibers in such articles may or may not be affected by the treatment as the polyamide fibers are treated in the process.

The dyes contained in the fiber to be treated with the fixing agent are anionic dyes and dyeing of the polyamide fiber is accomplished by uptake of the dyes through the association of the dye molecules with nitrogen-containing groups on the polyamide polymer molecules. Most anionic dyes are members of the well-known class of "acid" dyes. Another type of anionic dyes is the type referred to as "pre-metallized" dyes which are the reaction products of, for example, chromium or cobalt and selected dyes. As will become apparent hereinafter, mixtures of two or more dyes are often used to achieve a desired shade. In this application, the word "dye" may be used to refer to a single dye or multiple dyes as in a mixture of dyes used in a dyeing process or on a dyed article.

The dye fixing agent can be any of a variety of fixing agents known for application to polyamide fiber to improve dye washfastness. These agents are typically compounds or low molecular weight polymers with anionic groups which can associate with the nitrogen-containing groups of the polyamide polymer and form a surface layer that reduces diffusion of the dye out of the treated fiber. The process is well-suited for the class of such agents referred to as "Syntans", i.e., condensation products of aromatic sulfonic acids and formaldehyde and their derivatives. Syntans and their derivatives include sulfonated napthol-formaldehyde condensation products; sulfonated phenol-formaldehyde condensation products; polymers of methylacrylic acid or its alkali metal salt, and up to 70 weight percent of one or more monomers having ethylenic unsaturation and containing 2 to 20 atoms; a polymer of maleic acid or fumaric acid, or alkali metal salts thereof, and up to 70 weight percent of an ethylenically unsaturated aromatic comonomer containing 2 to 20 atoms; polymers of alpha-substituted acrylic acids or esters polymerized in the presence of a sulfonated aromatic formaldehyde condensation polymer; and polymers of a sulfonated hydroxyaromatic ester of an alpha-substituted acrylic acid or acrylic acid. Syntans are commercially available and are sold, for example, under the trademarks ERIONAL® by Ciba-Geigy Corp, Greensboro, N.C., INTRATEX® by Crompton & Knowles Corp., Stamford, Conn., MESITOL® by Mobay Corp. Pittsburgh, Pa., and NYLOFIXAN® by Sandoz Chemical Corp., Charlotte, N.C.

In the process of the invention, the article to be treated is immersed in a dyeing bath containing a liquid solvent medium for the fixing agent. The dyeing bath can take a wide variety of forms in which the article is totally immersed in the bath throughout the dyeing process or is partially immersed at any one time and is moved in a cyclical or random fashion to provide contact for the entire article with the solvent. Partial immersion is useful for articles such as fabrics where the fabric can be progressively advanced through the bath, either in continuous rope form or by reciprocation of an article having a discrete length, so that the entire article is ultimately dyed.

A preferred process employs the bath formed in a jet-dyeing apparatus for fabric in which the fabric is in the form of an endless rope and is moved by means of a jet nozzle supplied with solvent pumped from the bath. Machines of this type include a jet-dyeing machine (Gaston County Dyeing Machine Company), a circular jet-dyeing machine (Hisaka Works, Ltd.), "Uni-Ace" dyeing machine (Nippon Dyeing Machine Company), HT dyeing machine "Loco-Overflow" (Hokuriku Chemical Machinery Co. Ltd.), "Masflow" installation (Masuda Manufacturing Co., Ltd.), and the like.

The liquid solvent medium for the fixing agent can be an aqueous or nonaqueous medium which is a suitable solvent for the fixing agent, which is capable of transporting the fixing agent to the dye sites on the fiber and which is otherwise compatible with the fabric, fixing agent and other aspects of the process.

Preferably, the liquid solvent is an aqueous liquid which contains less than about 10% by weight of additives for establishing and maintaining the desired pH and for other purposes.

If the solvent medium is substantially nonaqueous, the medium preferably comprises about 10% by volume of a water-miscible alcohol selected from the class consisting of methanol, ethanol, ethylene glycol, propylene glycol and mixtures thereof. Preferably, the solvent medium comprises at least about 90% by volume of one or a mixture of these water-miscible alcohols. A preferred embodiment of the invention employs a bath of 100% methanol containing only the chemical additives necessary or desirable for the after-treating.

By "substantially nonaqueous" is meant that the solvent medium contains less than about 10% water by volume. With ethanol, for example, it is difficult to entirely eliminate water if the solvent medium is recycled by distillation since ethanol forms an azeotrope at a ratio of ethanol to water of about 95/5. At least some of the water typically held in the polyamide fiber will likely be introduced into the bath during dyeing.

The remainder of the substantially nonaqueous solvent medium for the fixing agent can be any of a variety of nonaqueous liquids provided they are otherwise compatible with the fabric, dye, fixing agent and other aspects of the process. These nonaqueous liquids may function as solvents for the fixing agent. Alternately, the fixing agent may only be insoluble or only slightly soluble in these liquids which will then act merely as diluents for the water-miscible alcohol or other solvents if other fixing agent solvents are present. Preferably, all of the non-aqueous liquids of the solvent medium are miscible with each other and with the water-miscible alcohols so that a one-phase dyeing bath is provided.

Similar to processes for after-treating polyamides in an aqueous dyebath, it is generally necessary for the substantially nonaqueous bath to be acidic. Typically, fixing agents are available commercially as sodium or potassium salts and the dyebath must be sufficiently acidic that they are effectively absorbed by the polyamide fiber. Suitable acids to provide acidity in the dyebath include organic acids such as acetic acid or formic acid.

It is possible for the after-treating with the fixing agent to be done in the same bath that was used for dyeing. This is advantageous since there is a significant reduction in the volume of spent dye liquors requiring treatment or disposal. If it is desired to dye and after-treat in the same bath, it is particularly advantageous to use the process disclosed in PCT Publication No. WO92/08838 (May 29, 1992) for application of the anionic dye imparting color to the fabric since that process can be employed to leave a very "clean" bath ideally suited for use in the application of fixing agents from the same bath.

The fixing agent is added to the bath as a liquid concentrate over a fixing agent addition period which will usually range between about 5 minutes and about 40 minutes. Upon stirring as will be explained in more detail, the liquid fixing agent concentrate is mixed with the solvent in the bath to form a dilute fixing agent solution.

"Liquid concentrate" is intended to refer to a solution in which the fixing agent is fully dissolved or dispersed and which can be added to and mixed with the liquid solvent medium in the bath to form a dilute liquid solution of the fixing agent. Preferably, if the solvent medium is substantially nonaqueous, the liquid concentrate is miscible with the solvent in all proportions of such concentrates which would normally be mixed into a dye bath so that a one-phase dilute dye solution is provided in the bath. The solvent medium for the liquid concentrate can be different than the liquid solvent medium provided that the introduction of a different solvent medium does not otherwise adversely affect the after-treating process. Because of the higher concentration of the fixing agent in the liquid concentrate, it may be desirable for the solvent medium of the concentrate to be a more effective solvent for the dye than the bath medium. When an aqueous after-treating bath is used, the solvent preferably used in the miscible liquid concentrate is water.

As will be explained in more detail hereinafter, the fixing agent addition rate is adjusted depending on the amount of fixing agent to be applied, the characteristics of the article to be treated, the type of dyeing apparatus, the type of fixing agent and the conditions of the after-treating to achieve the desired results. Preferably, to facilitate control over the process and make the process more easily reproducible, the fixing agent is added continuously and at a constant rate during the fixing agent addition period.

In processes in which the dilute fixing agent solution in the bath is circulated by means of a circulation pump, the liquid fixing agent concentrate is preferably added to the solvent ahead of the circulation pump. A metering pump is advantageously utilized for this purpose. Preferably, when after-treating fabric in a jet dyer, the circulation pump supplies the dilute fixing agent solution to the jet nozzle so that the newly-added fixing agent contacts the fabric first in the jet.

In a process in accordance with the invention, the dye bath containing the solvent medium and the article in the after-treating bath are heated to a temperature at least equal to the dyeing transition temperature. For the purposes of this application, dyeing transition temperature refers to the temperature during after-treating with a particular fixing agent at which a marked increase in the rate of fixing agent uptake. The dyeing transition temperature for a fixing agent/fiber combination may be determined by the test method described hereinafter and plotting % fixing exhaust with respect to dye bath temperature when increased at 3° C./min. The temperature at 15% exhaust is the dyeing transition temperature.

In a process in accordance with the invention, at least a portion of the fixing agent is added while the solvent and the article are at a temperature at least equal to the dyeing transition temperature. This part of the after-treating process can be referred to as the "rapid uptake phase", i.e., the time period where there is fixing agent in the bath and the solvent medium and article are at a temperature at least equal to the fixing dyeing transition temperature. In a process where no fixing agent is added to the bath until the solvent and article are at least equal to the dyeing transition temperature, the rapid uptake phase will begin when fixing agent is first added to the bath. In a process where fixing agent addition is begun before the bath is up to temperature, the rapid uptake phase will begin when the solvent and article reach a temperature at least equal to the dyeing transition temperature. In typical processes, the rapid fixing agent will end when the bath is exhausted toward or at the end of the after-treating process.

During the rapid uptake phase in one preferred process in accordance with the invention, the temperature of the bath and the article in the bath is maintained generally constant so that the after-treating process is not affected by temperature changes which may affect the rate of fixing agent uptake by the article. Generally, provided that the temperature remains above the dyeing transition temperature, the temperature should be controlled to within ±10° C., preferably ±5° C. Also, in aqueous systems, it is usually preferable for the pH to be maintained generally constant. It has been found that controlling the pH to within about ±0.2 units is suitable. With some fixing agents which are strongly alkaline, it may be desirable to meter a suitable acid solution such as acetic acid into the bath to keep the pH generally constant.

In a process in accordance with the invention, at least about 33% of the fixing agent is added to the bath when the solvent and the article are at least equal to the dyeing transition temperature. i.e., during the rapid uptake phase. Preferably, at least about 50% of the fixing agent is added during the rapid uptake phase.

Stirring of the bath during the fixing agent addition period and the rapid fixing agent uptake phase is done to mix the liquid fixing agent concentrate with the solvent in the bath to form a dilute fixing agent solution and to provide a flow of the dilute fixing agent solution relative to the article to cause the fixing agent to be transported to the article. The term "stirring" is intended to include any means of mixing and imparting relative motion between the article and the solvent in the bath. The relative motion between the article and the solvent can be imparted by circulating the solvent in the bath, moving the article in the solvent, or both moving the article and circulating the liquid. In the preferred process employing a jet-dyeing apparatus, both the article is moved and the bath liquid is circulated by action of circulating liquid with the fabric circulation being usually assisted by a rotating reel usually provided in such equipment.

The stirring also provides, on the average, essentially uniform transport of the anionic fixing agent to the article during the fixing agent addition period and rapid fixing agent uptake phase so that a fixing agent is applied to produce a sufficiently "level" application of fixing agent. Thus, during a process in which there are a number of repetitive cycles as in the preferred form of the invention in a jet dyer where the fabric rope cycles numerous times through the jet nozzle, the transport of fixing agent to the fabric may not be uniform in any one machine cycle. However, the additive effect of transport during all of the cycles is such that a level after-treating results since transport "on the average" is essentially uniform. As will become more apparent hereinafter, it may be desirable to increase the turnover rate, limit the addition rate of fixing agent, or both to decrease the percentage of total fixing agent added per cycle and thereby increase uniformity due to the greater averaging effect obtained. To facilitate control over the process and to enable a process to be repeated, it is preferable for stirring to be performed constantly and at a constant rate.

In accordance with the invention, the fixing agent addition rate is adjusted in the early stages of the process to be the primary control over the rate of uptake of fixing agent by the article at least while the solvent and the article are at or above the dyeing transition temperature. The type of adjustment of the addition rate necessary to accomplish this may be better understood by reference to Equation I which follows. Equation I takes into account factors impacting a dyeing process and is equally applicable to the after-treating process in accordance with the invention:

$$L = \frac{D_s}{K \cdot D_f} \times \frac{r}{\delta} \qquad \text{I}$$

In Equation I, Ds is the diffusion coefficient of the fixing agent in solution, Df is the diffusion coefficient of the fixing agent in the fiber, K is the equilibrium distribution coefficient for the dye-fiber system, r is the radius of the fiber, and $\delta$ is thickness of the diffusional boundary layer. In a process in accordance with the invention, it has been discovered that adjusting the rate of fixing agent addition into the bath and coordinating the rate with other conditions in the bath so that the rate of fixing agent addition is the primary control over the rate of fixing agent uptake provides low values for L in Equation I. It has further been discovered that the maximum benefits of the invention result when L is very low, preferably approaching zero.

To cause the rate of addition of the fixing agent to be the primary control over the rate of fixing agent uptake and thereby provide low L values, the rate of fixing agent addition is limited so that the fibrous article, which is readily capable of accepting fixing agent since it is above the dyeing transition temperature, is capable of accepting more fixing agent than is supplied to it. Under these conditions, the concentration of fixing agent in the bath is very much lower than in a conventional process and the influence of the diffusion coefficient in the fiber, Df, is therefore substantially less significant than in a conventional process. Also, the value for Ds/(K·Df) will be smaller than in a conventional process and will lead to lower L values, primarily because the value for K will increase if the concentration of fixing agent in the dye bath is less.

With the typical amount of fixing agents to be applied under the normal application conditions, the concentration of the fixing agent will increase in the later stages of application. The addition rate at the time should be such that a rapid build-up of fixing agent is avoided which could cause agglomeration of the fixing agent. Preferably, the rate of fixing agent addition is such that agglomeration is substantially avoided and the resulting after-treated fabric has no visible fixing agent deposits or spots.

In accordance with one form of the invention, rates of addition of fixing agent based on the fabric weight are about 0.0005 to 0.5% fixing agent/minute. In another form of the invention as in commercial processes employing a number of repetitive machine cycles, e.g., turnovers of the rope in a jet or beck dyer or circulation of the bath in a beam dyer, it is preferable to adjust the rate of fixing agent addition so that an amount of fixing agent between about 0.04% and about 7% of the total fixing agent is added in a machine cycle to achieve, on the average, essentially uniform fixing agent transport and a visually level after-treating in accordance with the invention. Most preferably, an amount of fixing agent between about 0.5% and about 3% is added during a machine cycle. Using laboratory jet and beck dyeing equipment, percentages of total fixing agent per cycle are typically lower since laboratory equipment usually has a high turnover rate which would not be practical for use in large commercial dyeing equipment although excellent results are obtained.

In the preferred form of the invention, it is usually only necessary to carefully control the process during the rapid uptake phase and, at most other times during the process, temperature and other bath conditions need not be as carefully controlled. For example, elevating the bath to the desired temperature can be done quickly and pH (or acidity in substantially nonaqueous mediums) adjustment prior to fixing agent addition can be done expeditiously and without the degree of care required in the conventional process for after-treating nylon.

After the after-treating is complete, the after-treating bath is cooled if necessary, typically to below about 140° F. (60° C.) for aqueous mediums and dropped. For nonaqueous mediums, the bath is cooled if necessary and transferred typically to another vessel for recovery. The article can be rinsed, dried and subsequently used in a conventional manner.

FIG. 1 shows a cross-sectional photomicrograph at 200× of a preferred after-treated fabric in accordance with the invention which has been treated with a cationic optical whitener. From FIG. 1, it is seen that the yarn filaments adjacent to the outside surfaces of the 66 nylon continuous filament yarns contain more fixing agent than filaments in the interior of the yarn. In the yarn shown in FIG. 1, the fixing agent is concentrated sufficiently in the outer filaments that some of the interior filaments appear to have little or no fixing agent as evidenced by the penetration of the optical whitener. In addition, fixing agent distribution in the filaments is asymmetric, i.e., more fixing agent being present on one side or the other. It will be understood that in continuous filament yarns, the same filaments may exhibit different after-treating effects along the length of the yarn since the filaments may be in different positions in the yarn bundle.

Figure 2:
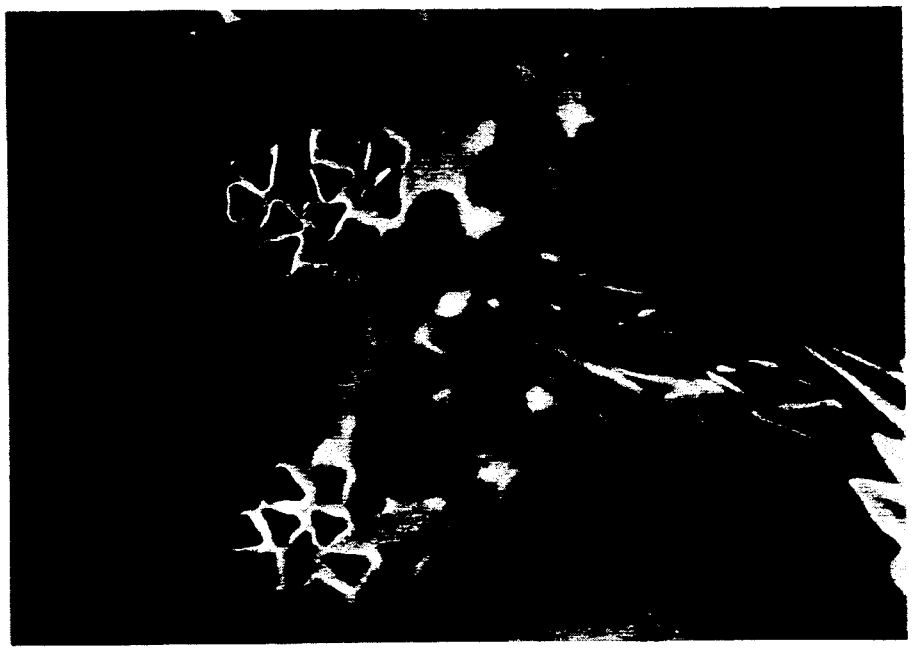
FIG. 2 is a cross-sectional photomicrograph at 200× of a yarn from the same type of fabric as FIG. 1 but after-treated in a conventional manner.

FIG. 2 is a cross-sectional photomicrograph at the same magnification of a fabric dyed conventionally in the same apparatus. It is apparent that the fixing agent is distributed more evenly throughout the yarn bundle with little difference between surface and interior filaments.

Despite the asymmetric after-treating of the yarns and filaments, fabrics of the invention have equivalent or better washfastness than those treated conventionally.

Although the invention is applicable to other types of fabrics such as non-wovens and tufted fabrics used for carpeting, preferred fabrics in accordance with the invention are selected from the class consisting of knitted and woven fabrics.

TEST METHODS

The Dyeing Transition Temperature is determined for a fiber/fixing agent combination as follows:

It is desirable for this test procedure to employ a sample of the article which has been dyed with the same dye which will be treated in the after-treating process.

A bath (without the article) containing 800 g water is adjusted to 30° C. and 1% (based on the weight of the article) of the fixing agent to be used and 5 g/l of monobasic sodium phosphate are added. The pH is adjusted to 5.0 using monobasic sodium phosphate and acetic acid. If the bath is substantially nonaqueous, a bath of the nonaqueous solvent medium to be used in the process under consideration is set (without the article). Acid of the same type and percentage to be used substantially nonaqueous bath is also added. A sample of the dyed article which provides a 20–50 liquor ratio is added and the bath temperature is increased at a rate of 3° C./min to 95° C. for aqueous systems or within 5° C. of the boiling point for nonaqueous mediums.

With every 5° C. rise in bath temperature a fixing agent liquor sample of ~25 ml is taken from the fixing agent bath. The samples are cooled to room temperature and the absorbance of each sample at a UV wavelength known to be useful for monitoring the fixing agent is measured on a spectrophotometer such as a Perkin-Elmer C522-000 UV-visible spectrophotometer (Perkin-Elmer Instruments, Norwalk, Conn. 06856) using a water reference.

The % fixing agent exhaust is calculated and plotted with respect to dyebath temperature. The temperature at 15% exhaust is the dyeing transition temperature.

Yarn Cross-sectional Micrographs

The after-treated fabrics is first treated in an aqueous bath containing 1% of a cationic whitening agent sold under the trademark HOSTALUX NR ® by Hoechst Chemical and 0.2% nonionic wetting agent such as that sold under the trademark MERPOL DA ® by E. I. du Pont de Nemours & Company. The pH is adjusted to about 5 using acetic acid and the bath is heated to 80° F. (26.7° C.). A sample of the after-treated fabric is added to provide a liquor ratio of approximately 20 and the bath is stirred for 15 minutes. Then, the sample is rinsed and dried.

Fabric swatches, or yarn bundles, are embedded in "MARGLAS", or a similar epoxy resin designed for microtomy. Approximately ten micron thick sections are made using a steel microtome knife. These sections are cut in a direction which will enable examining cross sections of fibers at various depths into the fabric. The sections are placed on a microscope slide and immersed in a refractive index liquid which matches, and therefore renders invisible, the epoxy embedding material. Magnifications of 100× to 500×, using objective lenses of 10× to 40× are convenient and useful for assessing distributions of fixing agent within the filaments, within the yarn bundles and through the fabric thickness.

The invention is illustrated in the following examples which are not intended to be limiting. Percentages are by weight unless otherwise indicated.

EXAMPLE 1

Part 1

This demonstrates conventional use of a dye fixing agent.

Ten grams of formaldehyde condensation copolymer of sodium naphthalene sulfonate and 4,4'-dihydroxydiphenylsulfone (approximately 37% solids) are diluted with 2,000 ml of deionized water. This solution is adjusted to pH 4.5 with acetic acid and then further diluted with deionized water to 2,500 ml. This 2,500 ml of ~0.15% by weight solution of fixing agents (assuming 37% solids) is introduced into a Werner-Mathis Laboratory Jet Dyeing Apparatus, Type JF, sold by Werner-Mathis, U.S.A. of Concord, N.C. To test its shear-stability, the fixing agent solution is pumped through the jet nozzle of the dyer while heating to 160° F. (71.1° C.) at 8° F. (4.4° C.) per minute. Pumping is continued for 20 minutes at 160° F. (71.1° C.). These are typical pH, temperature and time conditions for after-treating nylon to improve the wetfastness of acid dyes.

The pump is then stopped and the solution is collected in a large beaker and cooled. The originally clear solution is now noticeably turbid due to agglomeration of the syntan fixing agent. When measured in a spectrophotometer, the fixing agent solution shows a significant increase in optical density compared to the original solution at 550 nm as detailed in Table I.

Part 2

This illustrates the improvement in shear stability of a fixing agent solution which can be provided by a metering the fixing agent as in a process in accordance with the invention.

Ten grams of formaldehyde condensation copolymer of sodium naphthalene sulfonate and 4,4'-dihydroxydiphenylsulfone (approximately 37% solids) is dissolved in 40 ml of deionized water. The solution is acidified to pH 4.5 with acetic acid, then diluted with deionized water to a final volume of 80 ml.

Separately, 2420 ml of deionized water (adjusted to pH 4.5 with acetic acid) are introduced into the jet dye apparatus and heated to 160° F. (71.1° C.) while pumping through the jet nozzle of the apparatus. The previously prepared 80 ml of fixing agent solution is then metered into the jet dyer over 20 minutes (4 ml per minute) with a precision (approximately 1% accuracy) Monostat compulab liquid metering pump sold by Monostat Corporation of New York, N.Y.

The metering pump and the jet dyer pump are stopped after the 20 minute metering period and the solution is collected and cooled as per the previous example. The solution is noticeably less turbid than the solution resulting from Part 1. Optical density measured at 550 mm confirms that the dilute fixing agent solution as will be employed in a process in accordance with the invention is significantly less turbid (56.5% improvement) than that obtained when using the conventional process. The data from these tests is reported in Table I.

Part 3

The same procedure of Part 1 is repeated except that the following nylon fabric is put through the jet nozzle of the dyeing apparatus and sewn at the ends to form an endless tube before the 2500 ml of fixing agent solution is introduced into the dyebath. The fabric used is fifty grams of a circular knit, tubular fabric (4½ in. tubular; 8½ in. open width×62 in.) from a 40 denier, trilobal 3.08 dpf 66 nylon yarn.

As indicated by the data shown in Table 1, the cooled solution is noticeably turbid but less so than in Example 1.

Part 4

The same procedure of Part 2 is employed except the same nylon fabric as in Part 3 is put through the jet nozzle of the dyeing apparatus and sewn at the ends to form an endless tube before the 2420 ml of deionized water (pH 4.5) are added. The rate of fixing agent addition is 0.37% fixing agent/minute based on the weight of fabric.

The cooled solution from the process of the invention is noticeably less turbid than the solution from the conventional process of Example 3. Optical density measurements at 550 nm as reported in Table 1 confirm that the solution from the process of the invention is significantly less turbid (63.5% improvement) than that of the solution of Part 3 which represents the solution of a conventional process.

TABLE 1

| EXAMPLE 1 | Optical Density vs. water | % Improvement |
|---|---|---|
| Part 1 - Conventional | | |
| Original Solution pH 4.5; 0.4% Fixing Agent | 0.003 | |
| Solution After Jet-dryer Without Fabric | 0.168 | |
| Part 2 - Metering | | |
| Solution After Jet-dryer Without Fabric | 0.073 | 56.5 |
| Part 3 - Conventional | | |
| Solution After Jet-dryer With Fabric | 0.115 | |
| Part 4 - Metering | | |
| Solution After Jet-dryer With Fabric | 0.042 | 63.5 |

EXAMPLE 2

Part 1—Comparative

Using known techniques, 606 pounds (264.16 kg) of a conventional, autoclave heat-set, Swiss pique fabric knit from 2-ply, 70-17 false-twist textured nylon yarns is dyed a red shade in open-width form in a Hisaka, 2-port jet-dye machine, model CUT-FL, manufactured by Hisaka Works Ltd., Osaka, Japan.

The bath is dropped, the dyed fabric is rinsed. In a fresh bath, pH is adjusted to 4.5 with acetic acid at 120° F. (49° C.). Then 2.2% on weight of the dyed fabric (36.36 lbs., 16.49 kg) of a formaldehyde condensation copolymer of sodium naphthalene sulfonate and 4,4'-dihydroxydiphenylsulfone (~37% by weight solids) after-treating agent, is added to the bath over five minutes. The temperature is raised to 160° F. (71° C.) at 3° F. (1.67° C.)/minute. The after-treating bath and the fabric are circulated in the jet dyer for 20 minutes at 160° F. (71° C.). The bath is then cooled to 120° F. (49° C.) then dropped and the fabric is rinsed in a fresh bath at 120° F.

The fabric is dried and then inspected. Numerous hard, white spots are observed throughout the fabric. Analysis demonstrates that the spots are deposits containing the after-treating agent.

Part 2—Invention

The procedure of Example 1 is used to dye the same fabric to the same red shade except that the bath is not dropped at the completion of the dye cycle. The bath is adjusted to pH 4.5 with acetic acid and cooled to 160° F. (71° C.). This temperature is above the fixing agent transition temperature.

Then 36.36 lbs (16.49 kg) of the same dye fixing agent as in Example 1 (6% on weight of the dyed fabric) is dissolved in 30 gallons (113.56 liters) of water. This concentrate is then metered into the pH 4.5 spent dye bath through the inlet of the circulating pump of the Hisaka jet dyer over 30 minutes. The rate of fixing agent addition is 0.074% fixing agent/minute based on the weight of the fabric. The time per turnover in the dyer is 1.5 minutes and the percentage of total fixing agent per fabric turnover is 5%.

The bath is cooled to 120° F. (49° C.) and dropped. The fabric is rinsed, then dried and inspected. No fixative spots are found. Subsequent laboratory tests show that the wetfastness of the fabric of the invention is equivalent to the control.

Part 3—Invention

The process as in Part 2 is repeated numerous times in a commercial operation to apply dye fixing to 70,000 lbs. (31,773 kg) of the same textured nylon Swiss pique fabrics and none of the fabrics are unacceptable for commercial sale because of fixative spots. In contrast, 30% of the same fabrics aftertreated by the conventional process as in Part 1 are unacceptable because of dye fixative spots. Additional benefits observed through use of the process of the invention include a reduction in cycle time reduced by 25%, water use is reduced by 65%, and steam requirements are reduced by 25%.

What is claimed is:

1. A process for increasing the washfastness of a fibrous article containing polyamide fibers dyed with anionic dye by treatment with an anionic dye fixing agent, said process comprising:

immersing said article in a liquid bath of a solvent medium for said fixing agent, said solvent medium being selected from the group consisting of aqueous solvent mediums and substantially nonaqueous solvent mediums;

heating said bath and said article in said bath to a temperature at least equal to the dyeing transition temperature of said fiber of polyamide polymer;

adding said fixing agent to said bath as a liquid concentrate, at least about 33% of the total fixing agent to be applied during said process being added while said bath and said article are at a temperature at least equal to said dyeing transition temperature; and stirring said bath as the fixing agent is added to said bath to mix said concentrate into said bath to form a dilute solution of said fixing agent and to provide a flow of said dilute fixing agent solution relative to said article to cause said fixing agent to be transported to said article, said stirring further providing, on the average, essentially uniform transport of said fixing agent to said article;

said fixing agent being added to the bath at an addition rate of about 0.0005 to about 0.5% fixing agent/minute based on the weight of said article.

2. The process of claim 1 wherein said fixing agent is selected from the group consisting of low molecular weight polymers with anionic groups which can associate with the nitrogen-containing groups of the polyamide polymer and form a surface layer that reduces diffusion of the dye out of the treated fiber.

3. The process of claim 1 wherein said fixing agent is selected from the group consisting of: sulfonated napthol-formaldehyde condensation products; sulfonated phenol-formaldehyde condensation products; polymers of methylacrylic acid or its alkali metal salt, and up to 70 weight percent of one or more monomers having ethylenic unsaturation and containing 2 to 20 atoms; a polymer of maleic acid or fumaric acid, or alkali metal salts thereof, and up to 70 weight percent of an ethylenically unsaturated aromatic comonomer containing 2 to 20 atoms; polymers of alpha-substituted acrylic acids or esters polymerized in the presence of a sulfonated aromatic formaldehyde condensation polymer; polymers of a sulfonated hydroxyaromatic ester of an alpha-substituted acrylic acid or acrylic acid; and mixtures thereof.

4. The process of claim 1 wherein said fixing agent is selected from the group consisting of sulfonated napthol-formaldehyde condensation products; sulfonated phenol-formaldehyde condensation products; and mixtures thereof.

5. The process of claim 1 wherein at least about 50% of said total fixing agent to be applied during said process is added while said bath and said article are at a temperature at least equal to said dyeing transition temperature.

6. The process of claim 1 wherein said polyamide polymer is selected from the group consisting of aliphatic polyamide homopolymers and copolymers.

7. The process of claim 6 wherein said aliphatic polyamide is selected from the group consisting of aliphatic polyamides containing at least one of poly(hexamethylene adipamide) or poly($\epsilon$-caproamide) polymer units in an amount greater than about 60% by weight.

8. A process for increasing the washfastness of a fibrous article containing polyamide fibers dyed with anionic dye by treatment with an anionic dye fixing agent, said process comprising:

immersing said article in a liquid bath of a solvent for said fixing agent, said solvent being selected from the group consisting of aqueous solvents and substantially non-aqueous solvents, said substantially non-aqueous solvents comprising at least about 10% by volume of a water-miscible alcohol;

heating said bath and said article in said bath to a temperature at least equal to the dyeing transition temperature of said fiber of polyamide polymer;

adding said fixing agent to said bath as a liquid concentrate, at least about 33% of the total fixing agent to be applied during said process being added while said bath and said article are at a temperature at least equal to said dyeing transition temperature; and stirring said bath as the fixing agent is added to said bath to mix said concentrate into said bath to form a dilute solution of said fixing agent and to provide a flow of said dilute fixing agent solution relative to said article to cause said fixing agent to be transported to said article, said stirring further providing, on the average, essentially uniform transport of said fixing agent to said article;

said process being performed in a dyeing machine in which said stirring provides repetitive machine cycles;

said fixing agent is being added to the bath at a fixing agent addition rate such that between about 0.04% and about 7% of the total fixing agent to be applied during said process is added to said bath during a machine cycle.

9. The process of claim 8 wherein said dye fixing agent addition rate is adjusted so that an amount of fixing agent between about 0.5% and 3% of the total fixing agent to be applied during said process is added to said bath during a machine cycle.

* * * * *